US005950979A

United States Patent [19]

Mira

[11] Patent Number: 5,950,979

[45] Date of Patent: Sep. 14, 1999

[54] PORTABLE AND FOLDABLE EASEL

[76] Inventor: Vicente M. Mira, 10131 SW. 108 St., Miami, Fla. 33176

[21] Appl. No.: 09/057,817

[22] Filed: Apr. 9, 1998

[51] Int. Cl.[6] ..... A47B 97/04

[52] U.S. Cl. ..... 248/460; 248/449; 248/464

[58] Field of Search ..... 248/460, 441.1, 248/447, 448, 449, 451, 454, 455, 462, 463, 464

[56] References Cited

U.S. PATENT DOCUMENTS

| | | | |
|---|---|---|---|
| 281,591 | 7/1883 | Werner | 248/463 |
| 374,116 | 11/1887 | Cross | 248/449 |
| 505,306 | 9/1893 | Bohlinger | 248/460 |
| 1,286,018 | 11/1918 | Jones | 248/455 |
| 2,019,214 | 10/1935 | Denny | 248/449 |
| 2,683,300 | 5/1954 | Jen | 248/464 |
| 3,095,834 | 7/1963 | Killen | 248/449 |
| 3,145,014 | 8/1964 | Neuwirth | 248/464 |
| 3,145,966 | 8/1964 | Landon | 248/464 |
| 3,226,077 | 12/1965 | Killen | 248/448 |
| 3,304,045 | 2/1967 | Bethoney | 248/451 |
| 3,759,482 | 9/1973 | Wright | 248/449 |
| 4,109,892 | 8/1978 | Hartung | 248/449 |
| 4,260,124 | 4/1981 | Heilman | 248/449 |
| 4,610,414 | 9/1986 | Schuck | 248/449 |
| 5,145,133 | 9/1992 | France . | |

OTHER PUBLICATIONS

"What's What," edited by Bragonier, Jr. & Fisher, p.364.

*Primary Examiner*—Ramon O. Ramirez
*Assistant Examiner*—Anita M. King
*Attorney, Agent, or Firm*—J. Sanchelima

[57] ABSTRACT

A stretcher for a canvas that includes three co-planar elongated members centrally foldable are pivotally interconnected with two horizontal elongated members. One of the elongated members has longitudinal slots along which one of the ends of each of the horizontal elongated members is sidably connected. Upper and lower canvas holders are slidably and adjustably mounted to the third elongated member, keeping the canvas rigidly in place. A supporting leg is removably and hingedly mounted to a predetermined position of the third elongated member and with a spacer member permits a user to achieve a desired inclination for the canvas being supported, when in working state. For storage or transportation, the elongated members are brought in abutting relationship with each other and the horizontal pivoting members are allowed to rotate sliding out one of their respective ends. Then, the elongated members are centrally folded and secured with straps.

6 Claims, 4 Drawing Sheets

PORTABLE AND FOLDABLE EASEL

BACKGROUND OF THE INVENTION

1. Field of the Invention

The present invention relates to a portable and foldable easel for supporting canvases and other similar objects.

2. Description of the Related Art

Many designs for canvas easels exist. The desired characteristics for these tools include stability and portability. The former requires sufficient structural integrity so that the stretchers can hold the canvas firmly and withstand the strokes delivered by the painter. Portability is also desired since this tool frequently needs to be transported by the user.

Conventional easels such as the one shown on page 364 of "What's What", edited by Reginald Bragonier Jr. and David Fisher, can not be readily transported since they are bulky.

Applicant believes that the closest reference corresponds to U.S. Pat. No. 5,145,133 issued to Robert W. France for a target holder. This patent discloses a target holder with elongated slots (28 and 30) with fastening members. However, it does not teach the use of canvas holders nor the hinge assemblies claimed herein.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide an easel that is portable and foldable in a compact form when not in use so that it is volumetrically efficient to store and transport.

It is another object of this invention to provide an easel that is adjustable to support pictures or rectangular frames of varying height.

It is still another object of the present invention to provide an easel that is structurally stable to withstand a painter's strokes.

It is yet another object of this invention to provide such an easel that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
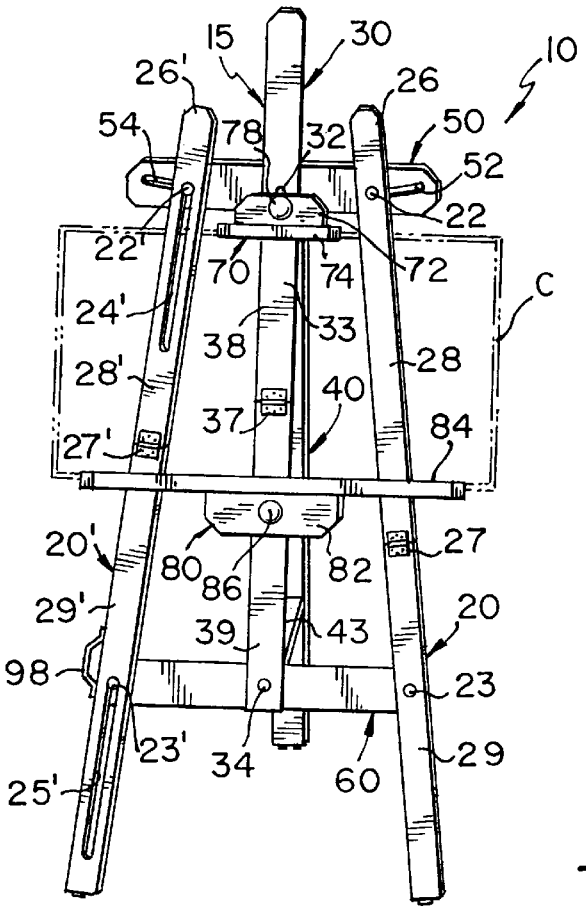
FIG. 1 is an isometric view from the front of the present invention supporting a canvas C, which is shown in phantom.

Referring now to the drawings, where the present invention is generally referred to with numeral 10, it can be observed that it basically includes supporting structure 15 kept in substantially vertical position by leg assembly 40. Supporting structure 15 comprises upright elongated members 20; 20' and 30 that are kept at a spaced apart and co-planar relationship with respect to each other by horizontal elongated members 50 and 60 that are separated from each other. Upper and lower canvas holders 70 and 80 are slidably mounted on upright elongated member 30 so that they can be adjusted along member 30.

Figure 2:
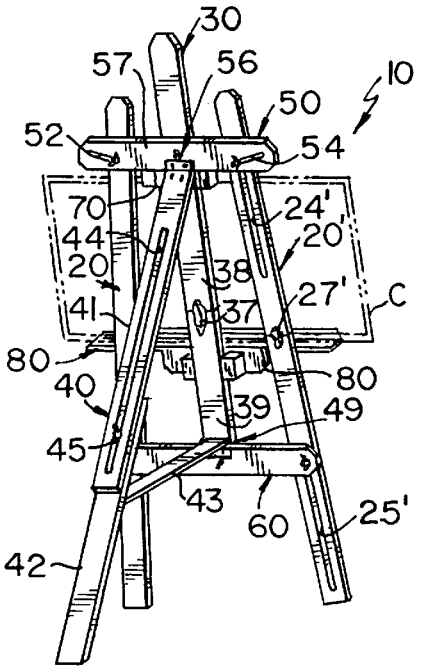
FIG. 2 is an isometric view from the back of this invention, showing a canvas in phantom.

FIGS. 1 and 2 illustrates easel 10 when in use. Upright elongated members 20 and 20' are pivotally mounted to elongated members 50 and 60 by bolt and nut members 22; 22'; 23 and 23', as shown in FIGS. 1 and 2. Bolt and nut members 22 and 22' horizontally slide along slots 52 and 54 of elongated member 50, respectively. Bolt and nut member 22' also slides along slot 24' once a user desires to make structure 15 collapse, as shown in FIG. 5*c*. Bolt and nut member 23 permits elongated members 20 and 60 to pivot about its axis. And, bolt and nut member 23', similar and simultaneously with bolt member 22', vertically slides along slot 25' of upright elongated member 20'. Slots 52 and 54 of elongated member 50, in the preferred embodiment, are disposed at a slight angle with respect to member 50, so that members 20 and 20' can be aligned in parallel relationship with respect to each other, as seen in FIG. 5*b*. In this preferred embodiment, uppermost ends 26 and 26' can be moved from slanted (or work) position to perpendicular position ( with respect to member 50) once a user desires to collapse structure 15, as shown in FIGS. 5*b* and 5*c*. Upright elongated member 20 and 20' include elongated members 28, 29, 28' and 29', respectively, connected with hinge assembly 27 and 27'. Similarly, upright elongated member 30 includes elongated members 38 and 39 hingedly connected with hinge assembly 37.

Elongated members 50 and 60 are pivotally mounted to upright elongated member 30 by bolt and nut members 32 and 34, respectively. Elongated member 30 has outwardly extended flanges 36 and 36' to cooperatively receive upper canvas holder 70, as best seen in FIG. 3.

Figure 3:
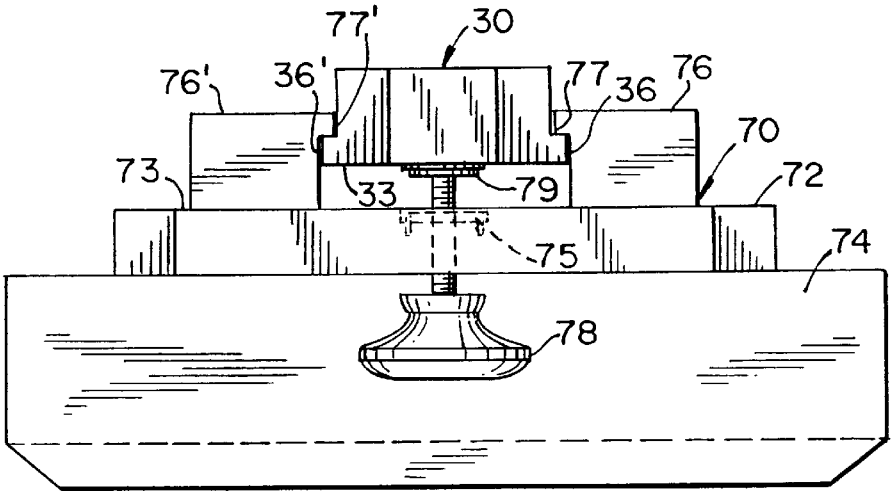
FIG. 3 is a top view of the upper canvas holder and elongated member 30.

Upper canvas holder 70, as best seen in FIGS. 1 and 3, includes supporting plate 72 perpendicularly mounted to one edge of plate 74. Supporting plate 72, in the preferred embodiment, has gripping members 76 and 76' rigidly mounted to rear surface 73 of plate 72. Gripping members 76 and 76' have inwardly extending flanges 77 and 77', respectively, that cooperatively keep elongated member 30 in slidable relationship with respect to holder 70. Outwardly extending flanges 36 and 36' of elongated member 30, as best seen in FIG. 3, cooperate with inwardly extended flanges 77 and 77'. Canvas C is placed over tray member 84 and elongated member 30, at the desired height and it is secured in place with holder 70. Set screw 78 is driven through nut 75 until plate 79 presses against front surface 33 of upright elongated member 30. This causes inwardly extended flanges 77 and 77' to be brought in frictional abutting contact with outwardly extended flanges 36 and 36', respectively, as shown in FIG. 3. In this manner, canvas C is firmly secured in place.

Lower canvas holder 80 is similar to upper canvas holder 70. Lower canvas holder 80 is slidably mounted to upright elongated member 30. Lower canvas holder 80 includes supporting plate 82 perpendicularly mounted to one edge of tray 84. Lower canvas holder 80 is held in place with set screw 86. Plate 74 and tray 84 are adjusted to support a canvas of varying height.

Figure 4A:
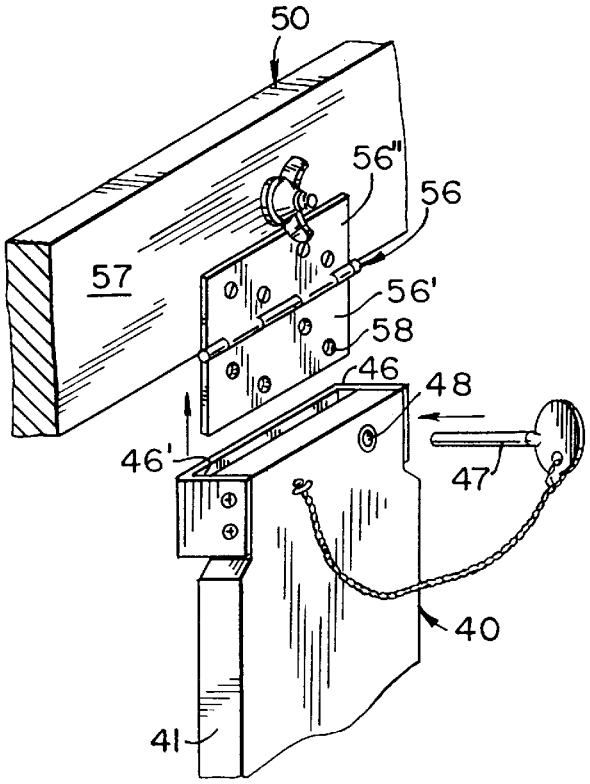
FIG. 4*a* is a partial isometric view of a hinge assembly.

Elongated members 20; 20'; 30; 50 and 60, as described above, are kept in a substantially upright position by leg assembly 40. Leg assembly 40, as best seen in FIG. 2, basically includes upper elongated member 41 slidably mounted to lower elongated member 42. Spacer member 43 is hingedly mounted to member 42 and it is designed to keep leg assembly 40 at an angular relationship with respect to structure 15. Upper elongated member 41 has slot 44 along which wing screw member 45 slides, and this is intended to adjust the angle of inclination of structure 15 with respect to the horizontal plane. As illustrated in FIG. 4*a*, elongated member 41 has retaining casing 46 and opening 46'. Opening 46' cooperatively receives hinge leaf 56' of hinge assembly 56. Hinge leaf 56" is mounted to the lower edge of rear surface 57 of elongated member 50. When hinge leaf 56' is placed inside opening 46', retaining pin member 47 is inserted through openings 48 and 58. In this manner, elongated member 41 is secured to the uppermost portion of structure 15.

Figure 4B:
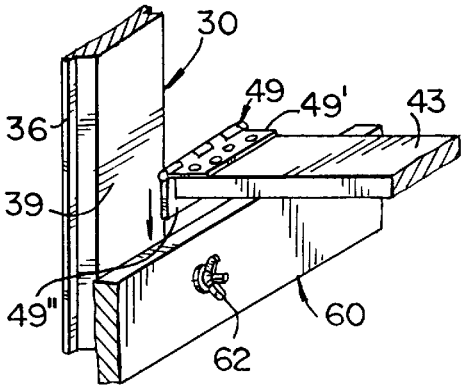
FIG. 4*b* is a partial isometric view of another hinge assembly.

Elongated spacer member 43 is hingedly mounted, at one end, to elongated member 42. The other end of elongated spacer member 43 is removably mounted to elongated member 30 and 60 with hinge assembly 49, as best seen in FIGS. 2 and 4*b*. As illustrated in FIG. 4*b*, hinge leaf 49' of hinge assembly 49 is fastened to the distal end of member 43 and hinge leaf 49" is inserted in a clearance between elongated members 30 and 60. Then, hinge leaf 49" is sandwiched between elongated members 30 and 60 by wing screw 62.

METHOD FOR FOLDING THE EASEL

Figure 5A:
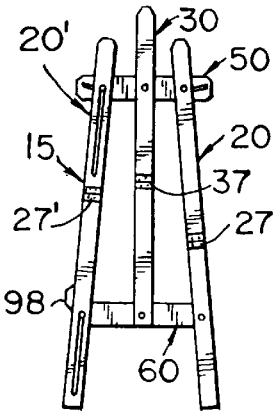
FIG. 5*a* is a front elevational view of this invention, showing a representation of the first step of folding the easel.
Figure 5B:
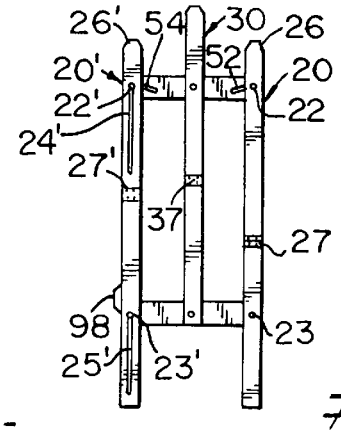
FIG. 5*b* is a representation of the second step of folding the easel, showing the upright elongated members in parallel relationship to each other.
Figure 5C:
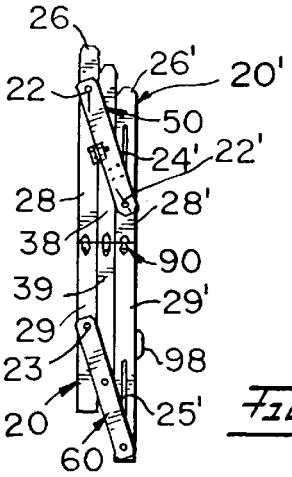
FIG. 5*c* is a representation from the back of the third step of folding the easel, showing the three upright and two horizontal elongated members in collapsible configuration and their hinges in alignment.
Figure 5D:
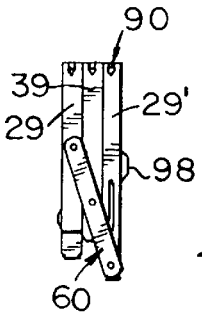
FIG. 5*d* is a representation of the fourth step of folding the easel, showing the upright elongated members folded in two sections by their hinges.
Figure 6:
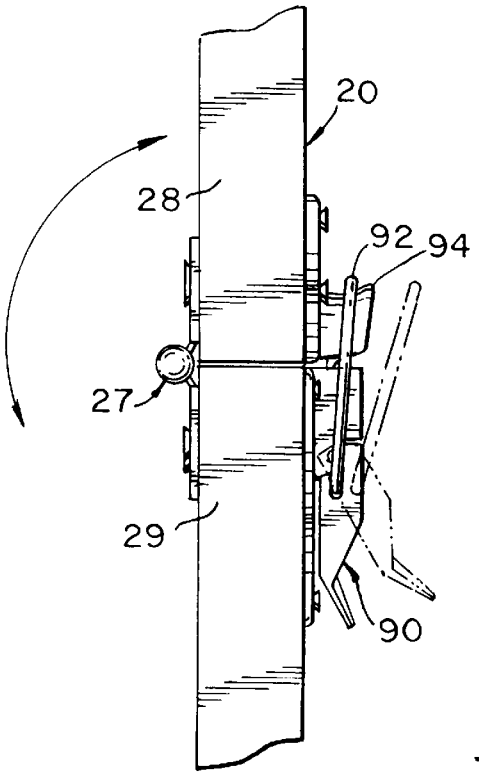
FIG. 6 is a partial side view of a tensor mounted to the back of an upright elongated member.
Figure 7:
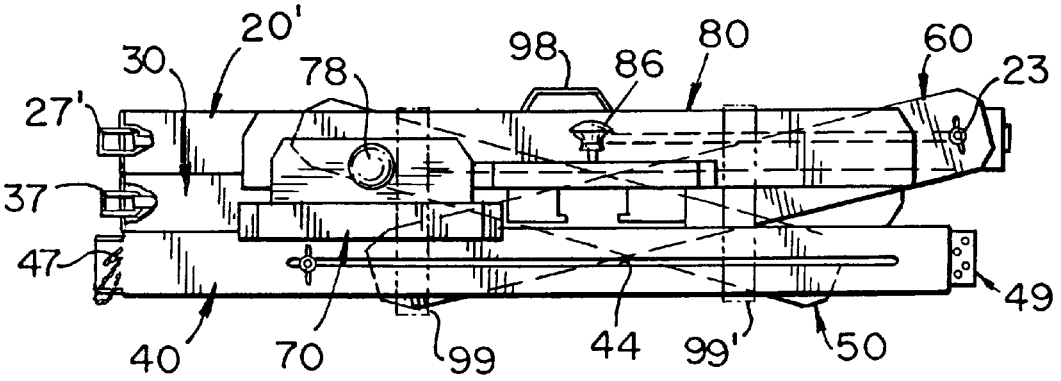
FIG. 7 represents this invention folded and readily to be stored and/or transported.

When a user wants to fold device 10, the sequence shown in figures 5*a*; 5*b*; 5*c* and 5*d* is followed for structure 15 after removed of canvas holders 70 and 80 and leg assembly 40. The first step is to remove canvas holders 70 and 80 by unscrewing set screw members 78 and 86. Leg assembly 40 is removed from structure 15 by removing hinge assemblies 49 and 56 from elongated members 60 and 50, respectively, leaving structure 15 as illustrated in FIG. 5*a*. Then, members 20 and 20' are placed at a parallel relationship with respect to each other by loosening bolt and nut members 22 and 22' and moving them along slots 52 and 54, respectively, as seen in FIG. 5*b*. Next, elongated member 20 is moved downwardly while upright elongated member 20' is moved up. As illustrated, hinge assemblies 27; 27' and 37 of upright elongated members 20; 20' and 30, respectively, are brought in a co-planar alignment. Then, tensor assemblies 90 are released. Latching members 92 of tensor assemblies 90 are removed from hooks 94, as best seen in FIG. 6. Finally, structure 15 is centrally folded and ready to be carried with handle 98 and secured by security straps 99 and 99', as shown in FIG. 7.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An easel for a canvas, comprising:

A) a structure having first, second and third upright elongated members, each having first and second ends and being centrally foldable, said first and second upright elongated members having similar dimensions, said structure further including first and second horizontal elongated members that each includes first and second ends and the center of said first horizontal elongated member is pivotally mounted to a point adjacent to the first end of said third upright elongated member and the center of said second horizontal elongated member is pivotally mounted to said third upright elongated member at a predetermined distance from the second end of said third upright elongated member, and said first upright elongated member includes first and second slots adjacent to the first and second ends of said first upright elongated member, the first ends of said first and second horizontal elongated member being slidably mounted to said first and second slots, respectively, and the second ends of said first and second horizontal elongated members being pivotally mounted to said second upright elongated member at a predetermined distance from said first and second ends, respectively, of said second upright elongated member so that said structure can be selectively disposed in working and folded state, said working state maintaining said first and second horizontal elongated members at a parallel and spaced apart relationship with respect to each other and perpendicularly disposed with respect to said third upright elongated member and said first and second upright member being kept at a spaced apart relationship defining a plane with said third upright elongated members, and said first, second and third upright elongated member include first, second and third hinge assemblies which are located at cooperative positions so that when kept in parallel abutting relationship all three can be centrally folded;

B) a leg assembly having first and second ends, said first end being removably mounted to said structure at a cooperative area so that the plane of said structure's first, second and third upright elongated members in the working state is kept substantially vertical;

C) a lower canvas holder slidably mounted along said third elongated member and having a cooperative surface to support the canvas and further including means for removably securing said lower canvas holder to said third elongated member at selected positions therealong; and D) an upper canvas holder slidably mounted along said third elongated member and having a cooperative surface to press said canvas against said lower canvas holder thereby keeping said canvas securely in place.

2. The easel set forth in claim 1 further including:

E) a removable spacer member connecting said leg assembly and said structure to maintain a predetermined angular separation between them.

3. The easel set forth in claim 2 where said structure includes first, second and third releasable tensor assemblies mounted on said first, second and third elongated members opposite to said first, second and third hinge assemblies so that said first, second and third elongated members can be selectively kept in extended and folded positions.

4. The easel set forth in claim 3 wherein said first horizontal elongated member includes a fourth hinge assembly having two hinge leaves and one of said leaves being rigidly mounted to said first horizontal elongated member and said first end of said leg assembly including a casing for receiving the other hinge leaf of said fourth hinge assembly.

5. The easel set forth in claim 4 wherein said leg assembly includes a locking pin and a first opening positioned at the first end of said leg assembly and the other hinge leaf of said fourth hinge assembly including a cooperating second opening so that said locking pin locking is removably inserted through said first and second openings.

6. The easel set forth in claim 5 wherein said second horizontal elongated member is separated from said third upright elongated member thereby defining a space inbetween, and said removable spacer member including first and second ends, said first end of the removable spacer including a fifth in lever assembly with two hinge leaves and one of the hinge leaves of said fifth hinge assembly being removably received within said space.

* * * * *